US010669887B2

(12) United States Patent
Allwood

(10) Patent No.: US 10,669,887 B2
(45) Date of Patent: Jun. 2, 2020

(54) VANE AIRFOIL COOLING AIR COMMUNICATION

(71) Applicant: United Technologies Corporation, Farmington, CT (US)

(72) Inventor: Thomas Allwood, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 135 days.

(21) Appl. No.: 15/897,307

(22) Filed: Feb. 15, 2018

(65) Prior Publication Data

US 2019/0249557 A1 Aug. 15, 2019

(51) Int. Cl.
*F01D 25/12* (2006.01)

(52) U.S. Cl.
CPC ..... *F01D 25/12* (2013.01); *F05D 2220/32* (2013.01); *F05D 2240/12* (2013.01); *F05D 2240/80* (2013.01); *F05D 2260/201* (2013.01)

(58) Field of Classification Search
CPC ..... F01D 25/12; F01D 25/08; F01D 9/065; F01D 5/187; F04D 29/58; F04D 29/5846; F05D 2220/32; F05D 2240/12; F05D 2240/80; F05D 2260/201
See application file for complete search history.

(56) References Cited

U.S. PATENT DOCUMENTS

| | | | | |
|---|---|---|---|---|
| 5,174,105 | A | 12/1992 | Hines | |
| 5,488,825 | A * | 2/1996 | Davis | F01D 5/187 415/115 |
| 5,498,126 | A | 3/1996 | Pighetti et al. | |
| 5,827,043 | A | 10/1998 | Fukuda et al. | |
| 6,619,912 | B2 | 9/2003 | Tiemann | |
| 7,040,097 | B2 * | 5/2006 | Mukherjee | F01D 5/186 60/775 |
| 2008/0112791 | A1 | 5/2008 | Lee et al. | |
| 2011/0268562 | A1 | 11/2011 | Knight et al. | |
| 2017/0002671 | A1 * | 1/2017 | Waite | F01D 9/02 |

OTHER PUBLICATIONS

EP search report for EP19157310.4 dated Jul. 2, 2019.

* cited by examiner

*Primary Examiner* — Richard A Edgar
(74) *Attorney, Agent, or Firm* — Getz Balich LLC

(57) ABSTRACT

A coolable airfoil for a gas turbine engine includes a suction side wall that extends from a leading edge to a trailing edge. A pressure side wall is joined to the suction side wall at the leading edge and the trailing edge and spaced from the suction side wall to form a cavity therein that includes a cooling circuit with a plurality of serpentine cooling passages. A cooling air inlet passage receives cooling air from a plenum formed between an outer platform and an engine case and routes the received cooling air from the plenum to the cooling circuit. The coolable airfoil may also include a cooling air feed elbow that includes a metering input orifice that receives compressor first discharge air that provides the received compressor first discharge air to a feed elbow cavity and is redirected via a feed elbow outlet passage to the cooling circuit.

17 Claims, 5 Drawing Sheets

VANE AIRFOIL COOLING AIR COMMUNICATION

BACKGROUND OF THE INVENTION

1. Technical Field

The present disclosure relates to internally cooled turbomachinery components and, more particularly to providing cooling air to a vane.

2. Background Information

The blades and vanes used in the turbine section of a gas turbine engine each have an airfoil section that extends radially across an engine flowpath. During engine operation the turbine blades and vanes are exposed to elevated temperatures that can lead to mechanical failure and corrosion. Therefore, it is common practice to make the blades and vanes from a temperature tolerant alloy and to apply corrosion resistant and thermally insulating coatings to the airfoil and other flowpath exposed surfaces. It is also widespread practice to cool the airfoils by flowing a coolant through the interior of the airfoils.

U.S. Pat. No. 5,827,043 assigned to the assignee of the present invention discloses that cooling air flows from a plenum to a cooling air inlet duct of the airfoil. As new combustors are developed there is a need for additional cooling in the high pressure turbine, including the vanes.

SUMMARY OF THE DISCLOSURE

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a coolable airfoil for a gas turbine engine, having a leading edge disposed between an inner platform and an outer platform. The coolable airfoil may comprise a trailing edge disposed between the inner platform and the outer platform. The coolable airfoil may further comprise a suction side wall extending from the leading edge to the trailing edge. A pressure side wall may be joined to the suction side wall at the leading edge and the trailing edge and spaced from the suction side wall to form a cavity therein that includes a cooling circuit with a plurality of serpentine cooling passages. A cooling air inlet passage receives cooling air from a plenum formed between the outer platform and an engine case and routes received air from the plenum to the cooling circuit. A cooling air feed elbow includes a metering input orifice that receives compressor first discharge air that provides the received compressor discharge air to a feed elbow cavity and is redirected via a feed elbow output passage to the cooling circuit.

The plenum may receive compressor second discharge air where pressure of the compressor first discharge air is higher than pressure of the compressor second discharge air.

The plenum ay receive $6^{th}$ stage high pressure compressor output air.

The metering input orifice may receive $8^{th}$ stage high pressure compressor output air.

The airfoil may be a high pressure turbine vane.

The metering input orifice may receive the compressor discharge air from a last compressor stage.

The metering input orifice may receive the compressor discharge air from a second to last compressor stage.

According to another aspect of the present disclosure, a gas turbine engine turbine vane is provided. The gas turbine engine vane may comprise a leading edge disposed between an inner platform and an outer platform. The gas turbine engine vane may further comprise a trailing edge disposed between the inner platform and the outer platform. A suction side wall may extend from the leading edge to the trailing edge. The gas turbine engine vane may further comprise a pressure side wall joined to the suction side wail at the leading edge and the trailing edge and spaced from the suction side wall to form a cavity therein that includes a cooling circuit with a plurality of serpentine cooling passages. A cooling air inlet passage may receive cooling air from a plenum formed between the outer platform and an engine case and routes received air from the plenum to the cooling circuit. The gas turbine engine vane may further comprise a cooling air feed elbow that includes an input orifice that receives compressor first discharge air from a source upstream of the plenum, where the input orifice provides the received compressor discharge air to a feed elbow cavity that directs the received compressor discharge air via a feed elbow output passage to the cooling circuit.

The plenum may receive $6^{th}$ stage high pressure compressor output air.

The input orifice may receive $8^{th}$ stage high pressure compressor output air.

The airfoil may be a high pressure turbine vane.

The metering input orifice may receive the compressor discharge air from a last compressor stage.

The metering input orifice may receive the compressor discharge air from a second to last compressor stage.

According to another aspect of the present disclosure, a gas turbine engine turbine vane is provided. The gas turbine engine vane may comprise a leading edge disposed between an inner platform and an outer platform. The gas turbine engine vane may further comprise a trailing edge disposed between the inner platform and the outer platform. A suction side wall may extend from the leading edge to the trailing edge. A pressure side wall may be joined to the suction side wall at the leading edge and the trailing edge and spaced from the suction side wall to form a cavity therein that includes a cooling circuit with a plurality of serpentine cooling passages. The gas turbine engine vane may further comprise a cooling air inlet passage that receives cooling air from a plenum formed between the outer platform and an engine case and routes received air from the plenum to a first inlet of the cooling circuit. The gas turbine engine may further comprise a cooling air feed elbow that includes an input orifice that receives compressor first discharge air from a source upstream of the plenum, where the input orifice provides received compressor discharge air via a feed elbow input passage to a feed elbow cavity that directs the received compressor discharge air via a feed elbow output passage to a second inlet of the cooling circuit.

The first and second inlets may be located adjacent to the outer platform.

The feed elbow inlet passage and the feed elbow outlet passage may be substantially perpendicular.

The plenum may receive compressor second discharge air where pressure of the compressor first discharge air is higher than pressure of the compressor second discharge air.

DETAILED DESCRIPTION

Figure 1:
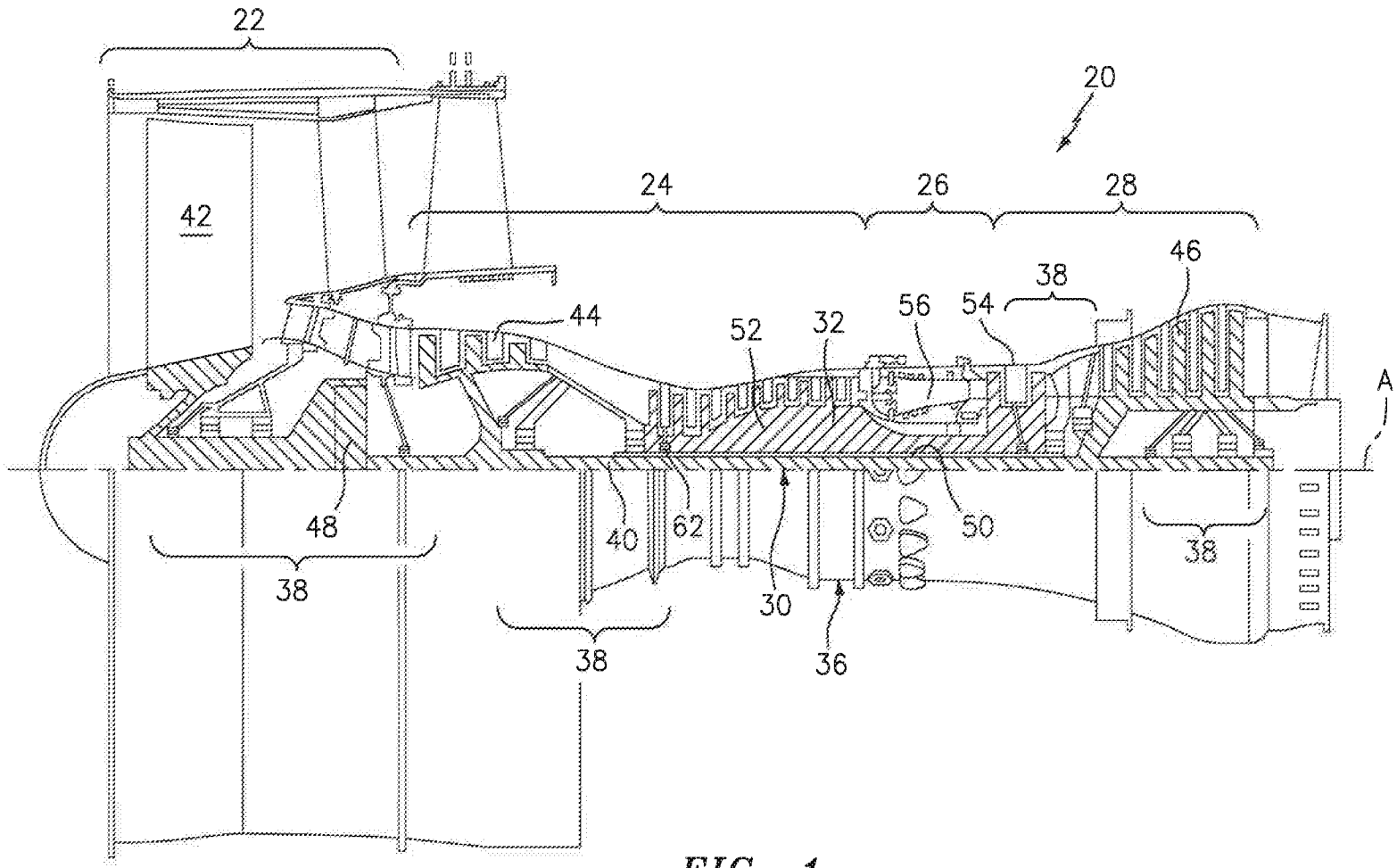
FIG. 1 schematically illustrates a turbofan engine.

It is noted that various connections are set forth between elements in the following description and in the drawings (the contents of which are incorporated in this specification by way of reference). It is noted that these connections are general and, unless specified otherwise, may be direct or indirect and that this specification is not Intended to be limiting in this respect. A coupling between two or more entities may refer to a direct connection or an indirect connection. An indirect connection may incorporate one or more intervening entities or a space/gap between the entities that are being coupled to one another.

Aspects of the disclosure may be applied in connection with a gas turbine engine.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engines (not shown) might include an augmentor section among other systems or features. Although depicted as a high-bypass turbofan in the disclosed non-limiting embodiment, it should be appreciated that the concepts described herein are not limited to use only with turbofan architectures as the teachings may be applied to other types of turbine engines such as turbojets, turboshafts, industrial gas turbines, and three-spool (plus fan) turbofans with an intermediate spool.

The engine 20 generally includes a low spool 30 and a high spool 32 mounted for rotation about an engine central longitudinal axis A relative to an engine case structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 may drive the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and a high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then expanded over the HPT 54 and the LPT 46. The LPT 46 and the HPT 54 rotationally drive the respective low spool 30 and high spool 32 in response to the expansion.

Figure 2:
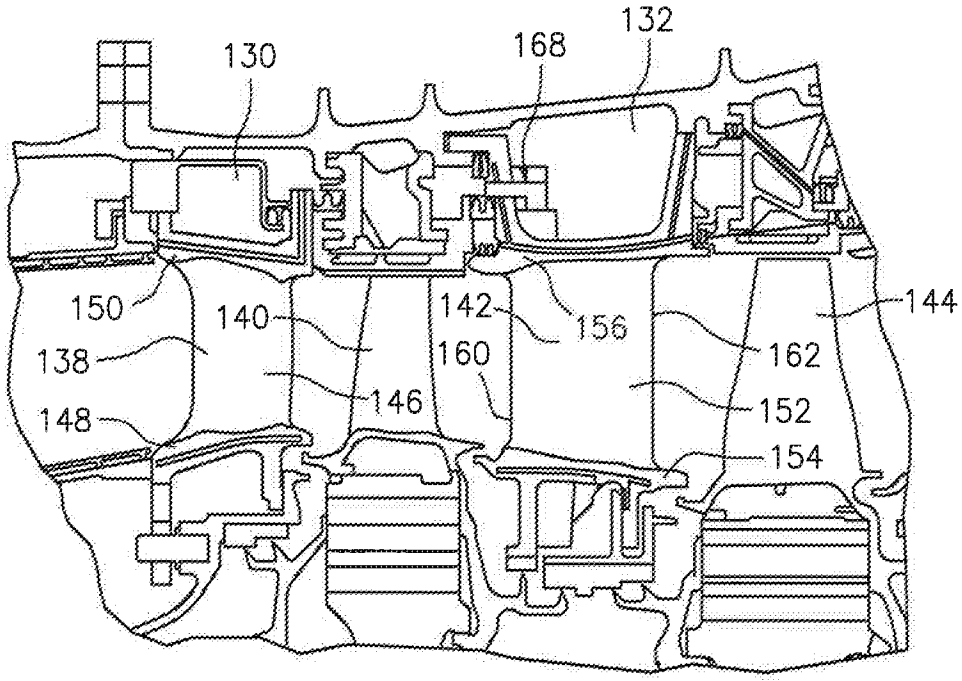
FIG. 2 is an enlarged section elevation of a portion of a turbine of a gas turbine engine showing a vane with improved cooling.

Referring to FIG. 2, a first plenum 130 is pressurized with a source of relatively constant, high pressure air bled from a high pressure stage of the compression section, bypassing the combustor. A second plenum 132 receives a source of relatively constant lower pressure air bled from a low pressure stage of the compression section, which is upstream the higher stage of compressor air bled to the first plenum 130.

The first stage of airfoils at the turbine entrance comprises a plurality of first stage vanes 138 followed by first stage rotatable blades 140 succeeded by second stage vanes 142 and second stage blades 144. The first stage vane 138 includes an airfoil portion 146. The first stage vane 138 has an inner platform 148 and an outer platform 150. The outer platform 150 is spaced radially inward from the case to leave the first plenum 130 therebetween. The second stage vane 142 includes an airfoil portion 152. The second stage vane has an inner platform 154 and an outer platform 156. The outer platform 156 is spaced radially inward from the case to leave the second plenum 132 therebetween.

The airfoil portion 152 of the second stage vane 142 includes a leading edge 160 and a trailing edge 162. The airfoil also includes a first radial end 164 and a second radial end 166. A suction side wall and a pressure side wall are joined at the leading edge and the trailing edge. The pressure side wall is spaced from the suction side wall to form a cavity therebetween. The cavity within the second stage vane 142 includes a cooling circuit (not shown) through which cooling air passes in order to cool the vane.

The second stage vane 142 receives cooling air from the second plenum 132 and supplemental cooling air from a feed elbow 168, which receives cooling air from the compressor and routes it to the cooling circuit within the vane. The cooling air from the feed elbow 168 is routed to the second stage vane 142 without mixing in the second plenum 132. The cooling air in the feed elbow 168 may be relatively constant, high pressure air bled from the last high pressure stage of the compression section, bypassing the combustor and first stage of the high pressure turbine in the secondary airflow cavity. The cooling air may also be taken from the second to last high pressure stage of the compression section.

Figure 3:
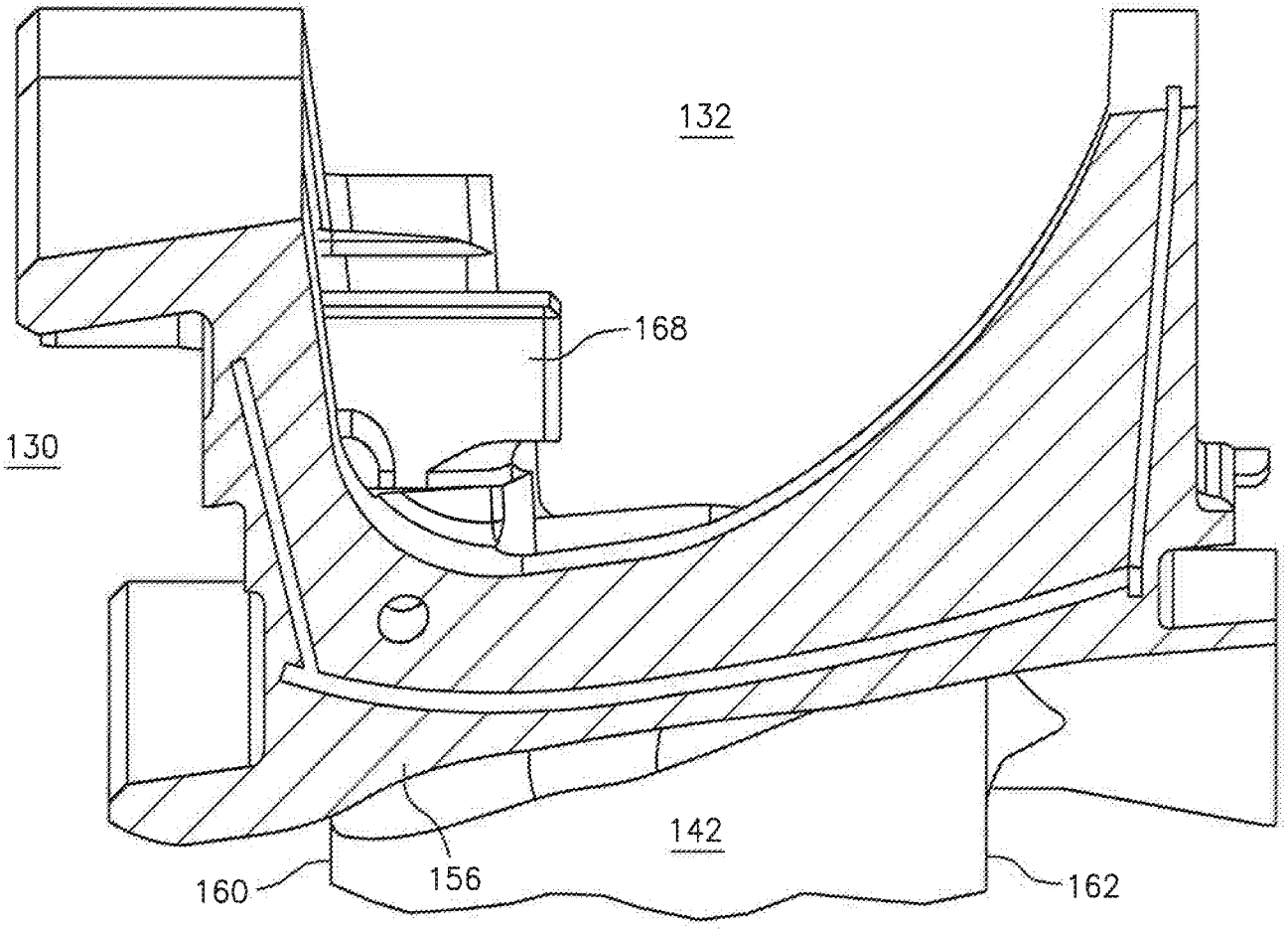
FIG. 3 is an enlarged section of a portion of an outer platform of a vane that includes an elbow that provides supplemental cooling air directly into the vane.

FIG. 3 is an enlarged section of a portion of the outer platform 156 of the second stage vane 142 illustrating the elbow 168 that provides supplemental cooling air directly into the vane 142. The vane also receives cooling air from the second plenum 132.

The cooling air in the second plenum 132 may be, for example, from the $6^{th}$ and $8^{th}$ stage of the compressor. The supplemental cooling air from the elbow 168 may be from, for example, the last high pressure stage of the compression section or the second to last stage of the compression section.

Figure 4:
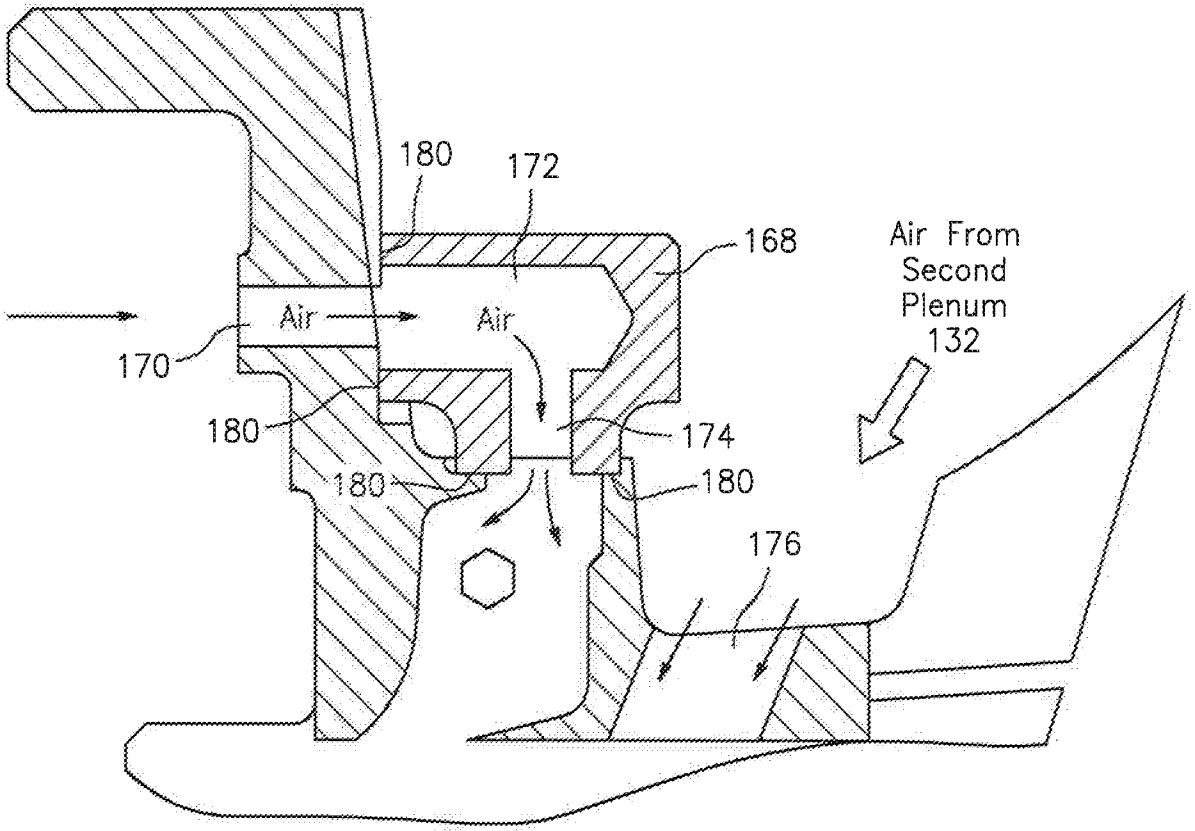
FIG. 4 is a further enlarged section illustrating the feed elbow that provides supplemental cooling air directly into the vane.

FIG. 4 is a further enlarged section illustrating the feed elbow 168 that provides supplemental cooling air directly into the vane 142 (FIGS. 2-3). The feed elbow includes a metering input orifice 170 that receives compressor discharge air and then enters a feed elbow cavity 172 that redirects the received compressor discharge air to the vane cooling circuit via a feed elbow output passage 174 to a first inlet passage in the vane. In addition, cooling air from the second plenum 132 is received by the vane via a second inlet passage 176 in the vane. The cooling air from the first and second inlet passages may mix within the vane before entering the serpentine cooling passages, and ultimately discharge, for example, from the inner diameter of the vane.

Figure 6B:
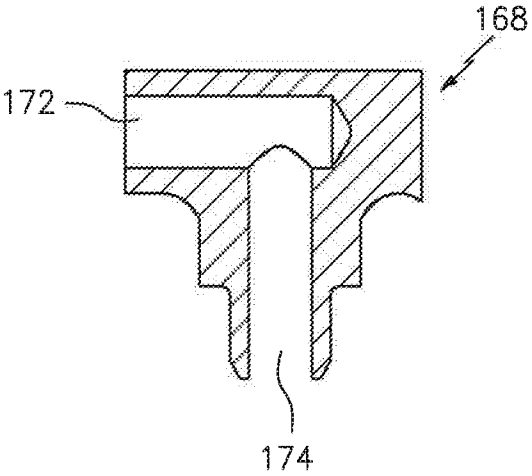
FIGS. 6A-6C are various cross sectional illustrations of the feed elbow.
Figure 6A:
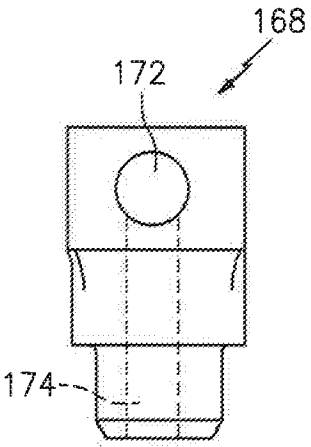
Figure 6C:
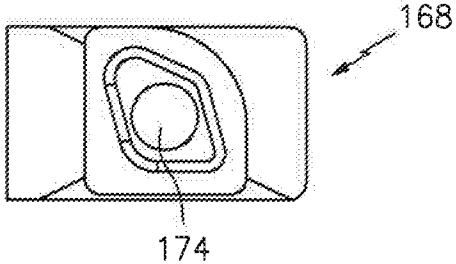
Figure 5:
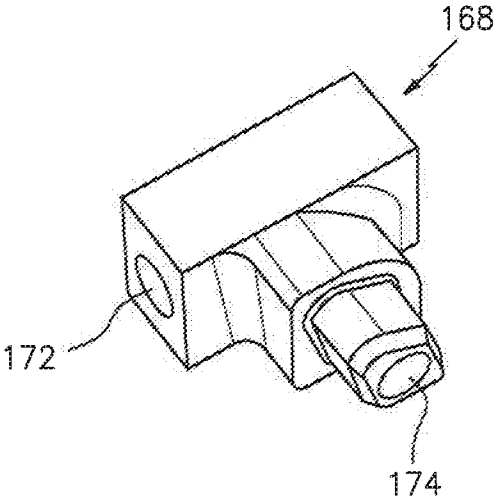
FIG. 5 is a pictorial illustration of the feed elbow.

FIG. 5 is a pictorial illustration of the feed elbow 168. FIGS. 6A-6C are various cross sectional illustrations of the feed elbow 168. The supplemental cooling air provided by the feed elbow reduces the local metal temperature of the vane thus improving its durability. The feed elbow may be made, for example, via Direct Metal Laser Sintering (DMLS), machined, and then brazed to the vane using either paste or braze "paper". In one embodiment the feed elbow 168 may be brazed to the vane at braze surface 180. Welding may also be used, but as known welding is limited by line of sight process and inspection capability.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments. For example, it is contemplated that the dirt separator for internally cooled components disclosed herein it not limited to use in vanes and blades, but rather may also be used in combustor components or anywhere there may be dirt within an internal flowing passage.

It should be understood that like reference numerals identify corresponding or similar elements throughout the several drawings. It should also be understood that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A coolable airfoil for a gas turbine engine, comprising:
- a leading edge disposed between an inner platform and an outer platform;
- a trailing edge disposed between the inner platform and the outer platform;
- a suction side wall extending from the leading edge to the trailing edge;
- a pressure side wall joined to the suction side wall at the leading edge and the trailing edge and spaced from the suction side wall to form a cavity therein that includes a cooling circuit with a plurality of serpentine cooling passages;
- a cooling air inlet passage that receives cooling air from a plenum formed between the outer platform and an engine case and routes the received cooling air from the plenum to the cooling circuit; and
- a cooling air feed elbow that includes a metering input orifice that receives compressor first discharge air that provides the received compressor first discharge air to a feed elbow cavity and is redirected via a feed elbow outlet passage to the cooling circuit.

2. The coolable airfoil of claim 1, where the plenum receives compressor second discharge air where pressure of the compressor first discharge air is higher than pressure of the compressor second discharge air.

3. The coolable airfoil of claim 2, where the plenum receives $6^{th}$ stage high pressure compressor output air.

4. The coolable airfoil of claim 2, where the metering input orifice receives $8^{th}$ stage high pressure compressor output air.

5. The coolable airfoil of claim 2, where the coolable airfoil is a high pressure turbine vane.

6. The coolable airfoil of claim 5, where the metering input orifice receives the compressor first discharge air from a last compressor stage.

7. The coolable airfoil of claim 5, where the metering input orifice receives the compressor first discharge air from a second to last compressor stage.

8. A gas turbine engine turbine vane, comprising:
- a leading edge disposed between an inner platform and an outer platform;
- a trailing edge disposed between the inner platform and the outer platform;
- a suction side wall extending from the leading edge to the trailing edge;
- a pressure side wall joined to the suction side wall at the leading edge and the trailing edge and spaced from the suction side wall to form a cavity therein that includes a cooling circuit with a plurality of serpentine cooling passages;
- a cooling air inlet passage that receives cooling air from a plenum formed between the outer platform and an engine case and routes the received cooling air from the plenum to the cooling circuit; and
- a cooling air feed elbow that includes an input orifice that receives compressor first discharge air from a source upstream of the plenum, where the input orifice provides the received compressor first discharge air to a feed elbow cavity that directs the received compressor first discharge air via a feed elbow outlet passage to the cooling circuit.

9. The gas turbine engine turbine vane of claim 8, where the plenum receives $6^{th}$ stage high pressure compressor output air.

10. The gas turbine engine turbine vane of claim 8, where the input orifice receives $8^{th}$ stage high pressure compressor output air.

11. The gas turbine engine turbine vane of claim 8, where the gas turbine engine turbine vane is a high pressure turbine vane.

12. The gas turbine engine turbine vane of claim 8, where the input orifice receives the compressor first discharge air from a last compressor stage.

13. The gas turbine engine turbine vane of claim 8, where the input orifice receives the compressor first discharge air from a second to last compressor stage.

14. A gas turbine engine turbine vane, comprising:
- a leading edge disposed between an inner platform and an outer platform;
- a trailing edge disposed between the inner platform and the outer platform;
- a suction side wall extending from the leading edge to the trailing edge;
- a pressure side wall joined to the suction side wall at the leading edge and the trailing edge and spaced from the suction side wall to form a cavity therein that includes a cooling circuit with a plurality of serpentine cooling passages;
- a cooling air inlet passage that receives cooling air from a plenum formed between the outer platform and an engine case and routes the received cooling air from the plenum to a first inlet of the cooling circuit; and
- a cooling air feed elbow that includes an input orifice that receives compressor first discharge air from a source upstream of the plenum, where the input orifice provides received compressor first discharge air via a feed elbow input passage to a feed elbow cavity that directs the received compressor first discharge air via a feed elbow outlet passage to a second inlet of the cooling circuit.

15. The gas turbine engine turbine vane of claim 14, where the first and second inlets are located adjacent to the outer platform.

16. The gas turbine engine turbine vane of claim 15, where the feed elbow inlet passage and the feed elbow outlet passage are substantially perpendicular.

17. The gas turbine engine turbine vane of claim 14, where the plenum receives compressor second discharge air where pressure of the compressor first discharge air is higher than pressure of the compressor second discharge air.

* * * * *